US011850713B2

(12) United States Patent
Ramge

(10) Patent No.: US 11,850,713 B2
(45) Date of Patent: Dec. 26, 2023

(54) CLAMPING DEVICE

(71) Applicant: DESTACO EUROPE GMBH, Oberursel (DE)

(72) Inventor: Markus Ramge, Bickenbach (DE)

(73) Assignee: DESTACO EUROPE GMBH, Oberursel (DE)

( * ) Notice: Subject to any disclaimer, the term of this patent is extended or adjusted under 35 U.S.C. 154(b) by 31 days.

(21) Appl. No.: 17/634,965

(22) PCT Filed: Aug. 5, 2020

(86) PCT No.: PCT/DE2020/100690
§ 371 (c)(1),
(2) Date: Feb. 12, 2022

(87) PCT Pub. No.: WO2021/027993
PCT Pub. Date: Feb. 18, 2021

(65) Prior Publication Data

US 2022/0379438 A1 Dec. 1, 2022

(30) Foreign Application Priority Data

Aug. 14, 2019 (DE) ..... 10 2019 121 860.8

(51) Int. Cl.
*B25B 5/00* (2006.01)
*B25B 5/08* (2006.01)

(52) U.S. Cl.
CPC ..... *B25B 5/08* (2013.01)

(58) Field of Classification Search
CPC ..... B25B 5/00; B25B 5/08; B25B 5/122
See application file for complete search history.

(56) References Cited

U.S. PATENT DOCUMENTS 5,165,670 A * 11/1992 Sawdon ..... B25B 5/061 269/32
6,059,277 A * 5/2000 Sawdon ..... B25B 5/122 269/27
6,076,816 A * 6/2000 Tunkers ..... B25B 5/122 269/91
2005/0017424 A1* 1/2005 Migliori ..... B25B 5/122 269/32

(Continued)

FOREIGN PATENT DOCUMENTS

DE 102016200180 A1 8/2017
DE 202018103239 U1 7/2018

OTHER PUBLICATIONS

International Search Report and Written Opinion of the International Search Authority, issued in PCT/DE2020/100690 dated Dec. 1, 2020; ISA/EP.

(Continued)

*Primary Examiner* — Lee D Wilson
(74) *Attorney, Agent, or Firm* — Harness, Dickey & Pierce, P.L.C.

(57) ABSTRACT

A clamping device has a clamping member (2) moveably mounted in a main body 1. A linearly movable actuator (3) is operatively connected to the clamping member (2). A spring element (4) is operatively connected to the actuator (3). A rotatably mounted actuating element (5) is operatively connected to the spring element (4). The spring element (4) is a compression spring that can be compressed when tensioning by the actuating element (5).

11 Claims, 4 Drawing Sheets

(56) References Cited

U.S. PATENT DOCUMENTS

| | | | | |
|---|---|---|---|---|
| 2005/0269755 | A1 | 12/2005 | Zhao et al. | |
| 2009/0026680 | A1 | 1/2009 | Doi | |
| 2022/0379438 | A1* | 12/2022 | Ramge | B25B 5/06 |

OTHER PUBLICATIONS

International Preliminary Report on Patentability issued in PCT/DE2020/100690, dated Feb. 8, 2022.

* cited by examiner

CLAMPING DEVICE

CROSS-REFERENCE TO RELATED APPLICATIONS

This application is a 371 U.S. National Phase of International Application No. PCT/DE2020/100690, filed Aug. 5, 2020, which claims priority to German Patent Application No. 10 2019 121 860.8, filed Aug. 14, 2019. The entire disclosures of the above applications are incorporated herein by reference.

FIELD

The disclosure relates to a clamping device with a clamping member moveably mounted in a main body. A linearly movable actuator is operatively connected to the clamping member. A spring element is operatively connected to the actuator. Also, a rotatably mounted actuating element operatively connected to the spring element. The spring element is formed as a compression spring that can be compressed during clamping by the actuating element.

BACKGROUND

A clamping device of the type mentioned at the outset is known from patent document DE 10 2016 200 180 A1. It has a clamping member that is movably mounted in a main body. A linearly movable actuator is operatively connected to the clamping member. A spring element is operatively connected to the actuator. A rotatably mounted actuating element is operatively connected to the spring element. In this solution, the spring element is formed as an extension spring (reference numeral 24 in this document) on account of the grooved plate (reference numeral 19 in this document).

SUMMARY

The object of the disclosure is to improve a clamping device of the type mentioned at the outset. In particular, the operation of such a clamping device is intended to be improved in the event that the spring element fails.

The object is achieved by a clamping device of the type mentioned at the outset with the following features. A clamping member that is moveably mounted in a main body. A linearly movable actuator is operatively connected to the clamping member. A spring element is operatively connected to the actuator. Also, a rotatably mounted actuating element operatively connects to the spring element. The spring element is formed as a compression spring that can be compressed during clamping by the actuating element.

According to the disclosure, the spring element is formed as a compression spring. It can be compressed during clamping by the actuating element.

In other words, the solution according to the disclosure utilizes compression spring instead of the extension spring. This has far-reaching consequences and advantages, especially in connection with other developments, that will be discussed in more detail below.

Other advantageous developments of the clamping device according to the disclosure can be found in the dependent claims.

DRAWINGS

The clamping device according to the disclosure and its advantageous developments according to the dependent claims will be explained in more detail in the following on the basis of the graphic representation of a preferred embodiment.

DETAILED DESCRIPTION

Figure 1:
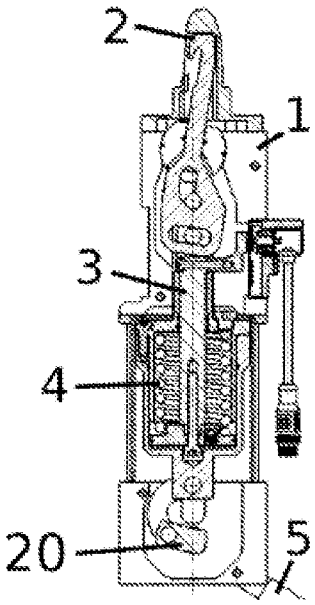
FIG. 1 is a sectional view of the clamping device in the open position.

The clamping device shown in the drawings has a clamping member 2, that is movably mounted in a main body 1, a linearly movable actuator 3, that is operatively connected to the clamping member 2, a spring element 4, that is operatively connected to the actuator 3 and a rotatably mounted actuating element 5, that is operatively connected to the spring element 4. See in particular, FIG. 1.

In this case, the clamping member 2 is formed as a clamping hook. A counter bearing 13 is provided on the main body 1 for the clamping hook. A centering pin 16 is provided on the main body 1 and the clamping member 2 is arranged in the centering pin 16, at least in part.

It is now essential for the clamping device according to the disclosure for the spring element 4 to be formed as a compression spring that can be compressed during clamping by the actuating element 5.

Figure 2:
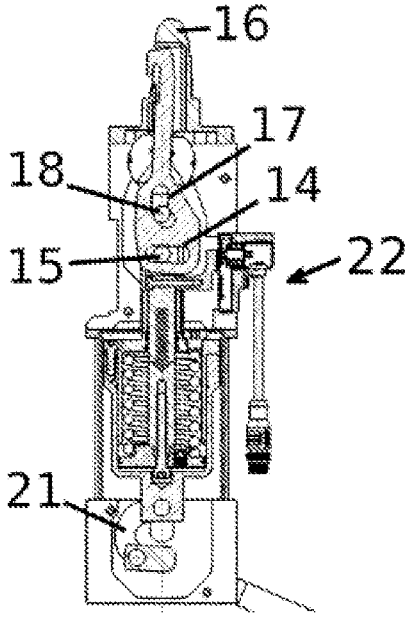
FIG. 2 is a sectional view of the clamping device according to FIG. 1 on its way into the closed position.

The clamping member 2 is pivotably and movably mounted in the main body 1. Likewise, a guide slot 14 is provided at the end of the clamping member 2 on the actuator side. A pin 15 engages the guide slot 14. The pin 14 is provided at the end of the actuator 3 on the side of the clamping member. In addition, a curved guide slot 17 is provided on the clamping member 2. A guide pin 18 engages the curved guide 17. The guide pin 18 is provided on the main body 1. See, in particular, FIG. 2.

In addition, an abutment element 6, for the spring element 4, is arranged at the end of the actuator 3 that faces away from the clamping member 2. In this case, the spring element 4 is formed as a helical compression spring. The abutment element 6 is disc-shaped. In addition, it is preferable for the actuator 3 to be centrally arranged on the abutment element 6. The spring element 4 is arranged concentrically with the actuator 3 on the abutment element 6. The spring element 4 is supported on the actuator 3 on one side and on an abutment 7, operatively connected to the actuating element 5, on the other side. Furthermore, the abutment 7 is arranged at one end of a housing 8, which is pot-shaped. The actuating element 5 is operatively connected to the other end of the housing 8. The abutment 7 is formed as a cover for the pot-shaped housing 8. A through-hole 19 is provided in the cover for the actuator 3. In addition, the abutment element 6 is mounted in the housing 8. The abutment element 6 is in the form of a piston in order to form a damper and/or for the housing 8 to be movably mounted in the main body 1.

Figure 8:
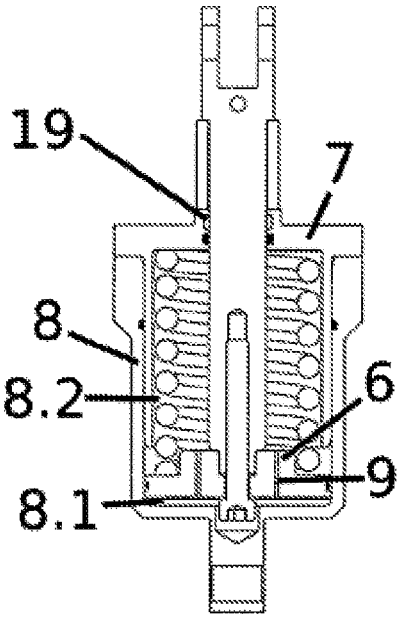
FIG. 8 is a first lateral sectional view of the loaded spring element according to FIG. 4.
Figure 9:
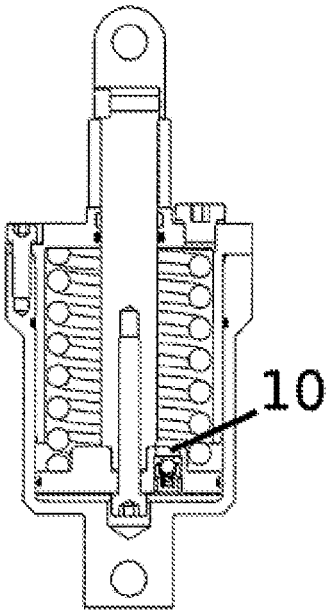
FIG. 9 is a second lateral sectional view of the loaded spring element according to FIG. 4.
Figure 10:
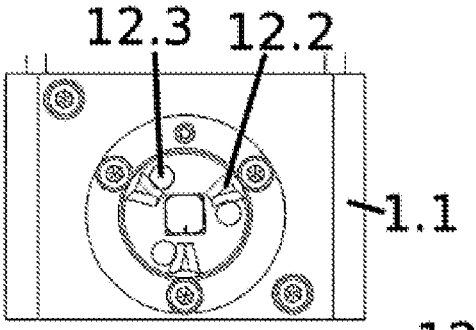
FIG. 10 is a lateral view of a housing portion of the clamping device, where a latching mechanism is arranged.
Figure 11:
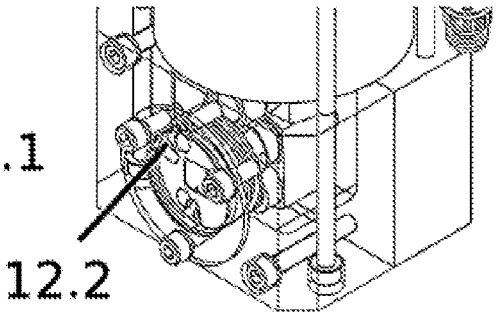
FIG. 11 is a transparent perspective view of the housing portion that houses the latching mechanism.
Figure 12:
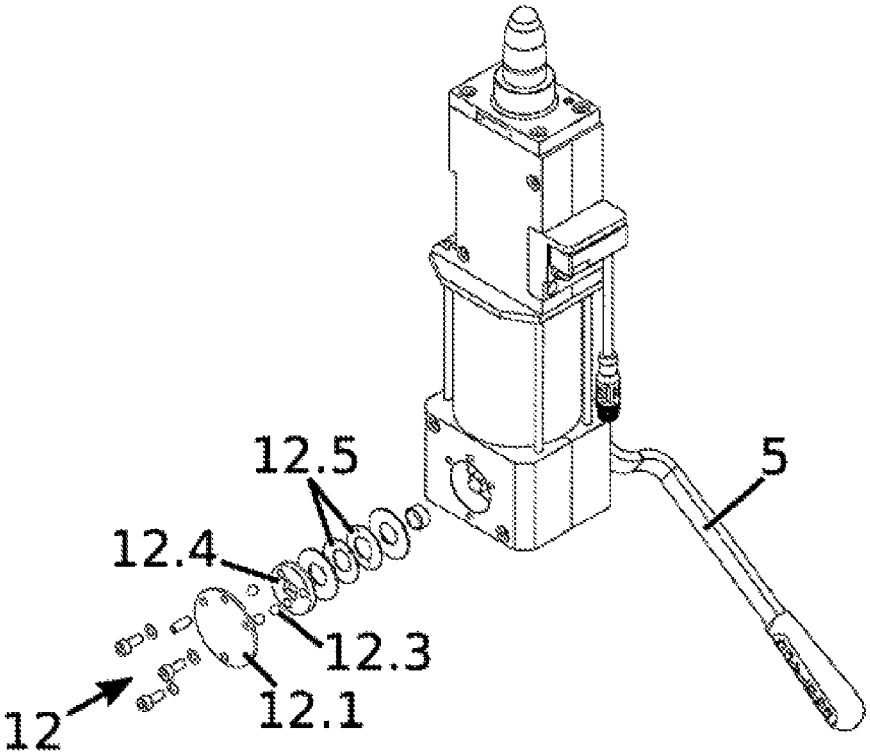
FIG. 12 is an exploded perspective view of the latching mechanism.

A channel 9 is arranged on the abutment element 6, the rest of which is sealingly guided in the housing 8. See, in particular, FIG. 8. In addition, a check valve 10 is arranged on the abutment element 6. The rest of the element is sealingly guided in the housing 8 with the exception of the channel 9. See, in particular, FIG. 9. In addition, both the channel 9 and the check valve 10 are each provided to fluidically connect two chambers 8.1, 8.2 arranged on either side of the abutment element 6. In this case, the housing 8, the chambers 8.1, 8.2, is/are preferably filled with a damping medium, preferably oil. In this case, it is preferable for the channel 9 to be dimensioned in a manner that prevents the spring element 4 from rapidly expanding and/or for the check valve 10 to be open during a movement of the abutment element 6 relative to the abutment 7 that causes the spring element 4 to compress. Also, the check valve is closed during a movement of the abutment element 6 relative to the abutment 7 that causes the spring element 4 to expand.

Figure 13:
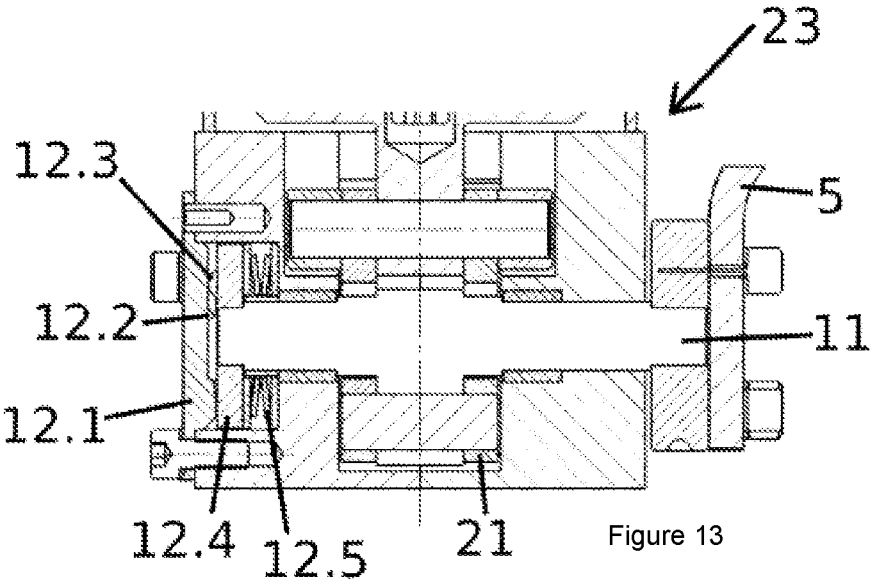
FIG. 13 is a sectional view of the housing portion, that houses a movement mechanism and the latching mechanism and on which the actuating element is arranged.

Furthermore, a rotary shaft 11 is rotatably mounted on the main body 1. The shaft 11 provides for rotatably mounting the actuating element 5. A lever arm 20 is arranged on the rotary shaft 11. An intermediate member 21 is hingedly mounted on the lever arm 20. In this case, the intermediate member 21 is hingedly connected to the housing 8. The rotary shaft 11, the lever arm 20 and the intermediate member 21 thereby preferably form (see FIG. 13) a movement mechanism 23.

In addition, it is preferable for the intermediate member 21 to be U-shaped and to surround the rotary shaft 11 in the clamped position. Likewise, the intermediate member 21 is preferably formed as part of a toggle lever device.

In addition, a latching mechanism 12 that holds the clamping device in the open position is provided on the rotary shaft 11, which is mounted in the housing portion 1.1. In this case, the latching mechanism 12 includes a plate 12.1, that is fastened to the main body 1, and a latching projection 12.2. A ball 12.3, interacts with the latching projection 12.2. A support plate 12.4 for the ball 12.3, is moveably connected to the rotary shaft 11 to rotate conjointly with it. A spring apparatus pushes the ball 12.3 against the plate 12.1. Furthermore, the spring apparatus is formed from at least one disc spring 12.5. See, in particular FIGS. 10 to 13. As becomes clear to a person skilled in the art from the present technical framework conditions, at least one latching projection 12.2 and at least one ball 12.3 must be provided in all cases. However, two, or particularly preferably even three, latching projections 12.2 and balls 12.3 are distributed across the circumference.

Lastly, an end position interrogation apparatus 22 interacts with the actuator 3 and preferably operates inductively. The interrogation apparatus 22 is arranged on the main body 1.

According to the embodiment shown in the drawings, the clamping device operates as follows:

The clamping device is firstly in an open position (see FIG. 1). The entire clamping member 2 is arranged in the centering pin 16 and the lever arm 20 is arranged in an upper or lateral position. In this state, the clamping device is held open, since the ball 12.3 of the latching mechanism 12 is blocked by the latching projection 12.2. Undesirable movement of the actuating element 5 by itself and therefore shifting of the intermediate member 21 is ruled out.

In order to bring the clamping device into the clamping position, the lever arm 20 is rotated downward by the actuating element 5. This moves the ball 12.3 past the latching projection 12.2 against resistance. As a result, the housing 8 is pulled downward in the main body 1 by the intermediate member 21. The actuator 3 is moved downward. The downward movement of the actuator 3 causes a downward movement of the clamping member 2 as a result of the actuator 3 and the clamping member 2 coupled by the guide slot 14 and the pin 15. This downward movement occurs at the same time as a pivot movement of the clamping member 2. The pivot arrangement is caused by the guide pin 18 traveling in the curved guide 17. The superposition of these two movements causes the clamping member 2 to leave the centering pin 16 to move in the direction of the counter bearing 13 to clamp a workpiece. The fact that the lever arm 20 and the intermediate member 21 are formed as part of a toggle lever device (movement mechanism 23) and the toggle lever is in an over-center position when the clamping device is in the clamped position ensures that the clamped position cannot loosen by itself. Together with the above-mentioned latching mechanism 12, this allows for operation of the clamping device.

Figure 3:
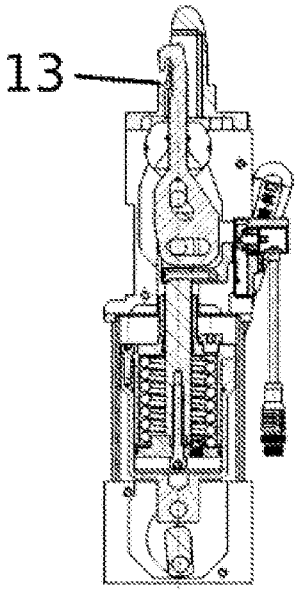
FIG. 3 is a sectional view of the clamping device according to FIG. 1 in the closed position when the spring element is placed under a large amount of load.

Should the clamping member 2 reach the workpiece, it cannot be pulled downward any further. The same also applies to the actuator 3 connected to the clamping member 2 and to the abutment element 6, connected to the actuator. The housing 8 together with the abutment 7 can, however, be lowered a little bit further when the lever arm 20 moves. Since the spring element 4 is positioned between the abutment element 6 and the abutment 7, the spring element 4 is compressed (cf. FIGS. 2 and 3). The resultant spring force counteracts undesirable opening of the clamping device and results in operating the clamping device. In addition, this ensures that the clamping position is maintained even if the spring element 4 fails. Furthermore, filling the chambers 8.1 and 8.2 of the housing 8 with a damping medium, as described above, is advantageous, since abrupt movements of the actuator 3 and, in particular, of the actuating element 5 arranged on the outside of the clamping device are damped or prevented.

Figure 4:
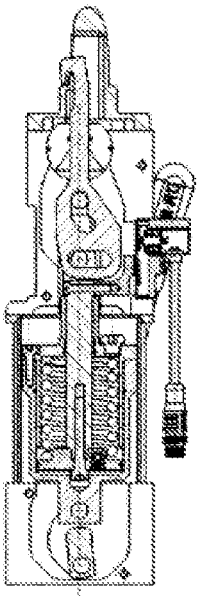
FIG. 4 is a sectional view of the clamping device according to FIG. 1 in the closed position when the spring element is placed under a small amount of load.
Figure 5:
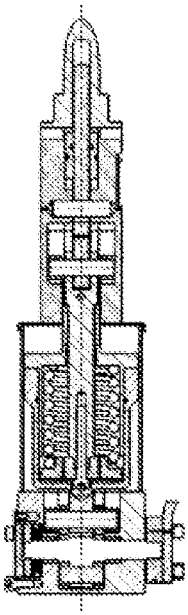
FIG. 5 is a sectional view from the side of the clamping device according to FIG. 4.
Figure 6:
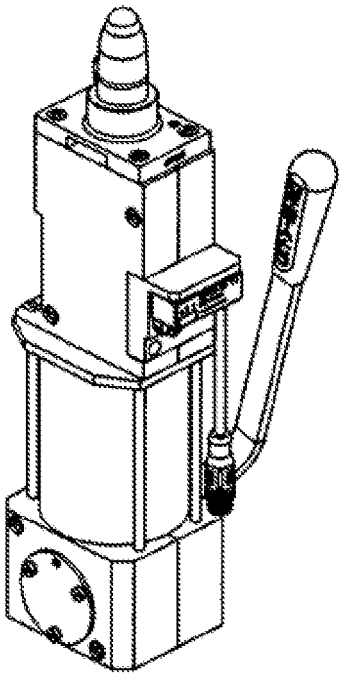
FIG. 6 is a first perspective view of the clamping device according to FIG. 1 in the closed position.
Figure 7:
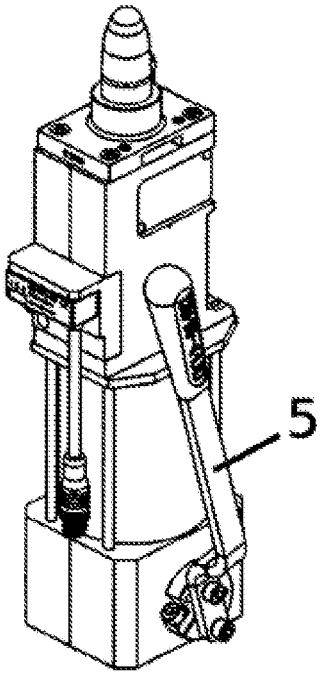
FIG. 7 is a second perspective view of the clamping device according to FIG. 1 in the closed position.

The spring force exerted by the spring element 4 is greater when clamping thicker workpieces than thinner ones. Thus, the spring element 4 is more greatly compressed in this case (cf. FIGS. 3 and 4). In this case, the flexible compression of the spring element 4 enables for a certain degree of tolerance compensation (which is very advantageous) in terms of the thickness of the workpiece while still providing sufficient clamping force in the event of very thin workpieces.

Another advantage of the clamping device according to the disclosure is, by using a compression spring as the spring element 4, an installation space is required for the spring element is smaller than in similar structures using an extension spring, while providing the same (high) clamping force.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A clamping device, comprising:

a clamping member, moveably mounted in a main body;

a linearly movable actuator operatively connected to the clamping member;

a spring element operatively connected to the actuator;

a rotatably mounted actuating handle operatively connected to the spring element; and the spring element is formed as a compression spring that can be compressed during clamping by the actuating element wherein the handle, moving between an open and closed position, is attached to a shaft extending through an outer housing of the main body.

2. The clamping device according to claim 1, further comprising an abutment element for the spring element arranged at the end of the actuator and faces away from the clamping member.

3. The clamping device according to claim 2, wherein the spring element supported on the actuator on one side and supported on an abutment operatively connected to the actuating element, on the other side.

4. The clamping device according to claim 3, wherein the abutment is arranged at one end of a housing and the actuating element is operatively connected to the other end of the housing.

5. The clamping device according to claim 4 wherein the abutment element is mounted in the housing in the form of a piston to form a damper.

6. The clamping device according to claim 4 wherein the housing is movably mounted in the main body.

7. The clamping device according to claim 5 wherein a channel is arranged on the abutment element, the rest of which element is sealingly guided in the housing.

8. The clamping device according to claim 7, further comprising a check valve arranged on the abutment element, the rest of which is sealingly guided in the housing with the exception of the channel.

9. The clamping device according to claim 8, wherein the check valve is open during a movement of the abutment element that causes the spring element to compress, and is closed during a movement of the abutment element that causes the spring element to expand.

10. The clamping device according to claim 1 further comprising a rotary shaft rotatably mounted on the main body for rotatably mounting the actuating element and a latching mechanism on the rotary shaft holding the clamping device in an open position.

11. The clamping device according to claim 6 wherein a channel is arranged on the abutment element, the rest of which element is sealingly guided in the housing.

* * * * *